US006368056B1

(12) United States Patent
Rabinovich et al.

(10) Patent No.: US 6,368,056 B1
(45) Date of Patent: Apr. 9, 2002

(54) STAGE IN A SUBMERGED MULTIPLE-STAGE PUMP

(75) Inventors: Alexandr Isaakovich Rabinovich; Oleg Mikhailovich Perelman; Pavel Borisovich Kuprin; Mikhail Jurievich Melnikov; Gennady Leonidovich Dorogokupets; Oleg Evgenievich Ivanov; Grigory Samarievich Tregubov; Igor Pavlovich Tryastsyn; Denis Jurievich Melnikov, all of Perm; Sharifzhan Rakhimovich Ageev, Moscow; Nikolai Vasilievich Gusin, Perm; Irina Vasilievna Vydrina, Perm; Galina Alexandrovna Shtennikova, Perm; Jury Lvovich Semenov, Perm, all of (RU)

(73) Assignee: Zakrytoe Aktsionernoe Obschestvo "Novomet-Perm", Perm (RU)

( * ) Notice: Subject to any disclaimer, the term of this patent is extended or adjusted under 35 U.S.C. 154(b) by 0 days.

(21) Appl. No.: 09/555,109

(22) PCT Filed: Nov. 24, 1998

(86) PCT No.: PCT/RU98/00396

§ 371 Date: May 24, 2000

§ 102(e) Date: May 24, 2000

(87) PCT Pub. No.: WO99/27257

PCT Pub. Date: Jun. 3, 1999

(30) Foreign Application Priority Data

Nov. 25, 1997 (RU) ..... 97120198

(51) Int. Cl.[7] ..... F04D 1/06; F04D 29/24

(52) U.S. Cl. ..... 415/199.2; 416/175; 416/203; 416/236 R; 416/181; 416/186 R

(58) Field of Search ..... 415/199.1, 199.2, 415/199.3, 171.1, 191, 193, 208.2, 209.1; 416/175, 203, 228, 235, 236 R, 181, 182, 183, 185, 186 R, 223 B

(56) References Cited

U.S. PATENT DOCUMENTS

| | | | | | |
|---|---|---|---|---|---|
| 2,775,945 | A | * | 1/1957 | Arutunoff | 415/199.2 |
| 3,238,879 | A | * | 3/1966 | Shallenberg | 415/131 |
| 3,730,641 | A | * | 5/1973 | Gordon | 415/199.3 |
| 4,278,399 | A | | 7/1981 | Erickson | |
| 4,741,668 | A | * | 5/1988 | Bearden | 415/199.1 |

FOREIGN PATENT DOCUMENTS

| | | | | | |
|---|---|---|---|---|---|
| CH | 544890 | | | 11/1973 | |
| DE | 744266 | A | * | 1/1944 | 415/199.2 |
| EP | 0 538 212 | | | 7/1992 | |
| GB | 2 143 285 | | | 7/1984 | |
| RU | 2094660 | | | 10/1997 | |
| SU | 1566088 | A | * | 5/1990 | 415/171.1 |
| SU | 1617208 | | | 12/1990 | |

OTHER PUBLICATIONS

"Novel low–delivery high–head pumps" by K.N. Spassky and V.V. Shaumian, Mowcow Mashinostroyeniye PH, 1973, p. 122 (in Russian).

"Centrifugal submersible pumps for oil production" by N.A. Bogdanov, Moscow Nedra PH, 1968, pp. 38–50 (in Russian).

* cited by examiner

*Primary Examiner*—Christopher Verdier
(74) *Attorney, Agent, or Firm*—Collard & Roe, P.C.

(57) ABSTRACT

A multistage oil-well pump for pumping out formation fluid has a higher pressure head at low delivery rates and higher stability of performance when gas pockets are present in the medium being transferred. To this end, in the stage of a multistage submersible pump, having an impeller which comprises a driving disk and a driven disk with vanes interposed therebetween, and a guide vane assembly with shaped vanes whose leading edges extend beyond the outside diameter of the external lid of the guide vane assembly, triangular cells are provided at the periphery of the impeller driving disk on the lateral surface thereof, which cells are open towards the disk outer side, and a side annular channel is provided on the surface of the external lid of the guide vane assembly, which surface mates with the impeller. The surface of the lateral annular channel is paced apart from the upper edge of the impeller cells at least 0.3 times the depth of the latter, and the radial length of the cells is not in excess of 0.3 times the driving disk radius.

3 Claims, 3 Drawing Sheets

STAGE IN A SUBMERGED MULTIPLE-STAGE PUMP

BACKGROUND OF TE NVENTION

1. Field of the Invention

The present invention relates in general to oil-industry mechanical engineering and more particularly, to multistage oil-well pumps for pumping out formation fluid.

2. The Prior Art

Known in the art are enclosed-design peripheral (vortex) pumps for transferring liquids free from abrasive particles, said pumps comprising an impeller appearing as a disk provided with cells arranged along its periphery, a peripheral-lateral working duct, an intake and a discharge branch pipe. The inlet and pressure chambers of the pump working duct are separated from each other by a web along the impeller periphery (cf. the textbook "Novel low-delivery high-head pumps" by K. N. Spassky and V. V. Shaumian. Moscow Mashinostroyeniye PH, 1973, p. 122 (in Russian)).

A disadvantage inherent in such pumps resides in an abrupt reduction of their pressure head and efficiency in case of increased end and radial clearances when transferring liquids containing abrasive particles.

Known in the art is also a combination pump (cf. Swiss Patent #544,890, IPC F04 D 5/00, 1973), comprising an enclosed impeller and vortex bladed rings arranged along the disk periphery and having radial dimensions exceeding the radial dimension of the impeller, an annular impeller outlet, and an annular webbed chamber of the vortex wheel.

A disadvantage inherent in such pumps resides in complicated construction of their working members, especially in manufacture of a multistage submersible pump, as well as an abrupt pressure head and efficiency reduction in the case of increased end and radial clearances in the vortex portion of the pump construction when transferring liquids containing abrasive particles.

Known in the art is a multistage centrifugal submersible pump for pumping out formation fluid from oil wells. Stages of such a pump comprise an enclosed impeller ar a guide vane assembly having vanes which are extendable beyond the diametrical dimension of the outside lid of the guide vane assembly. The impeller of the pump stag has specially shaped vanes interposed between the driving and driven disks (cf the textbook "Centrifugal submersible pumps for oil production" by N. A. Bogdanov. Moscow Nedra PH, 1968, pp.38–50 (in Russian).

Among the disadvantages of such a pump stage are low pressure developed by the stage at low stream rates and unstable performance characteristics when handling two- or three-phase oil-water-gas media.

SUMMARY OF THE INVENTION

Therefore the present invention has for its primary and essential object to provic such a stage of a mulstistage submersible pump that is capable of increasing the pressur head at low delivery rates and of higher stability of performance characteristic when handling two- or three-phase oil-water-gas media.

Said technical result is attainable with the stage of a multistage submersible pump, having an impeller which comprises a driving disk and a driven disk with vanes interposed therebetween, and a guide vane assembly with shaped vanes whose leading edges extend beyond the outside diameter of the external lid of the guide vane assembly. The stage according to the invention has triangular cells provided at the periphery of the impeller driving disk on the lateral surface thereof said cells being open towards the disk outer side, and a side annular channel on the surface of the external lid of the guide vane assembly, said surface mating with the impeller.

The herein-proposed pump stage is also characterized in that the surface of the lateral annular channel of the guide vane assembly is spaced apart from the upper edge the impeller cells at least 0.3 the depth of the latter.

Another distinguishing feature of the proposed pump stage resides in the fact that the radial length of the cells is not in excess of 0.3 times the driving disk radius.

DETAILED DESCRIPTION OF THE PREFERRED EMBODIMENT

Figure 1:
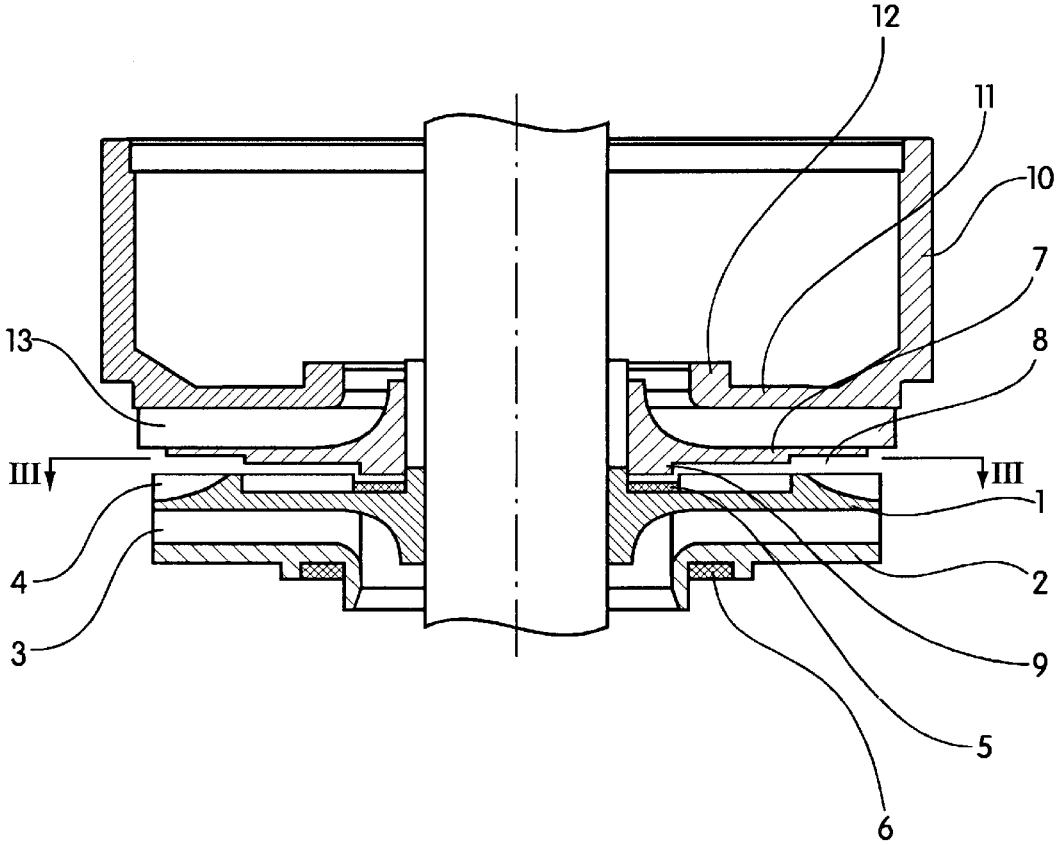
FIG. 1 is a cross-sectional view of the pump stage, according to the invention.
Figure 3:
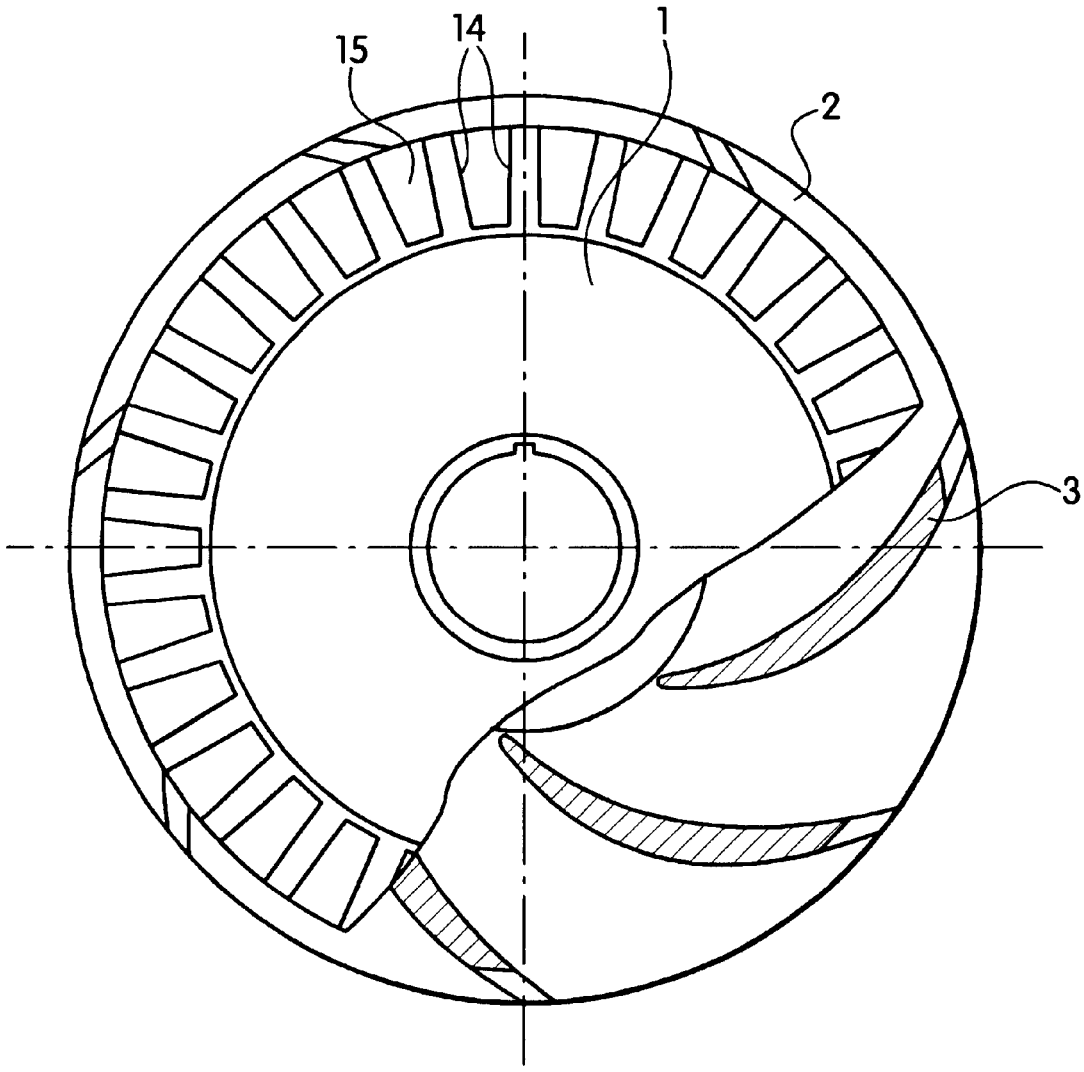
FIG. 3 is a cross sectional view along lines III—III of FIG. 1.

As shown in FIGS. 1 and 3, the pump stage impeller has a driving disk 1 and a driven disk 2 with shaped vanes 3 interposed therebetween, and triangular cells 4 provided at the driving disk periphery on the lateral surface thereof and formed by side walls 14 and surface 15 of driving disk 1, said cells being open towards the disk outer side. The vane sides of the cells may be variously shaped and be arranged radially, inclined forward along the direction of rotation, bent backward, "angle backward" or "angle forward". Gaskets 5 sand 6 are fitted on the outer surfaces of the respective disks.

The guide vane assembly has an external lid 7 with a lateral annular channel 8 and a shoulder 9, a side wall 10, and an inner wall 11 with a shoulder 12. The guide vane assembly has also shaped vanes 13 whose leading edges extend beyond the outside diameter of the external lid of the guide vane assembly.

The surface of the lateral annular channel of the guide vane assembly is spaced apart from the upper edge of the impeller cells at least 0.3 times the depth of the latter. and radial length of the cells is not in excess of 0.3 times the driving disk radius.

When the present pump stage operates at low delivery rates, the vane walls establish a turbulent stream (i.e., a vortex system) in the cells 4 and the lateral channel 8. The turbulent stream is incident upon the vanes 13 of the guide vane assembly that extend beyond the limits of the external lid 7, where kinetic energy acquired by the liquid is converted into pressure head which is added to the pressure head developed by the impeller centrifugal portion. In this case the turbulent streams established by the vane walls of the cells provide for, irrespective of the pump delivery rate, further dispersion when transferring oil-water-gas media, thus adding to the stable operation of the pump stages.

Regardless of the provision of a lateral channel in the guide vane assembly and of an arrangement of the leading edges of its vanes, impellers having triangular cells are in fact efficacious dispersing members and may therefore operation in pairs with any one ot heretofore-known guide vane assemblies.

Figure 2:
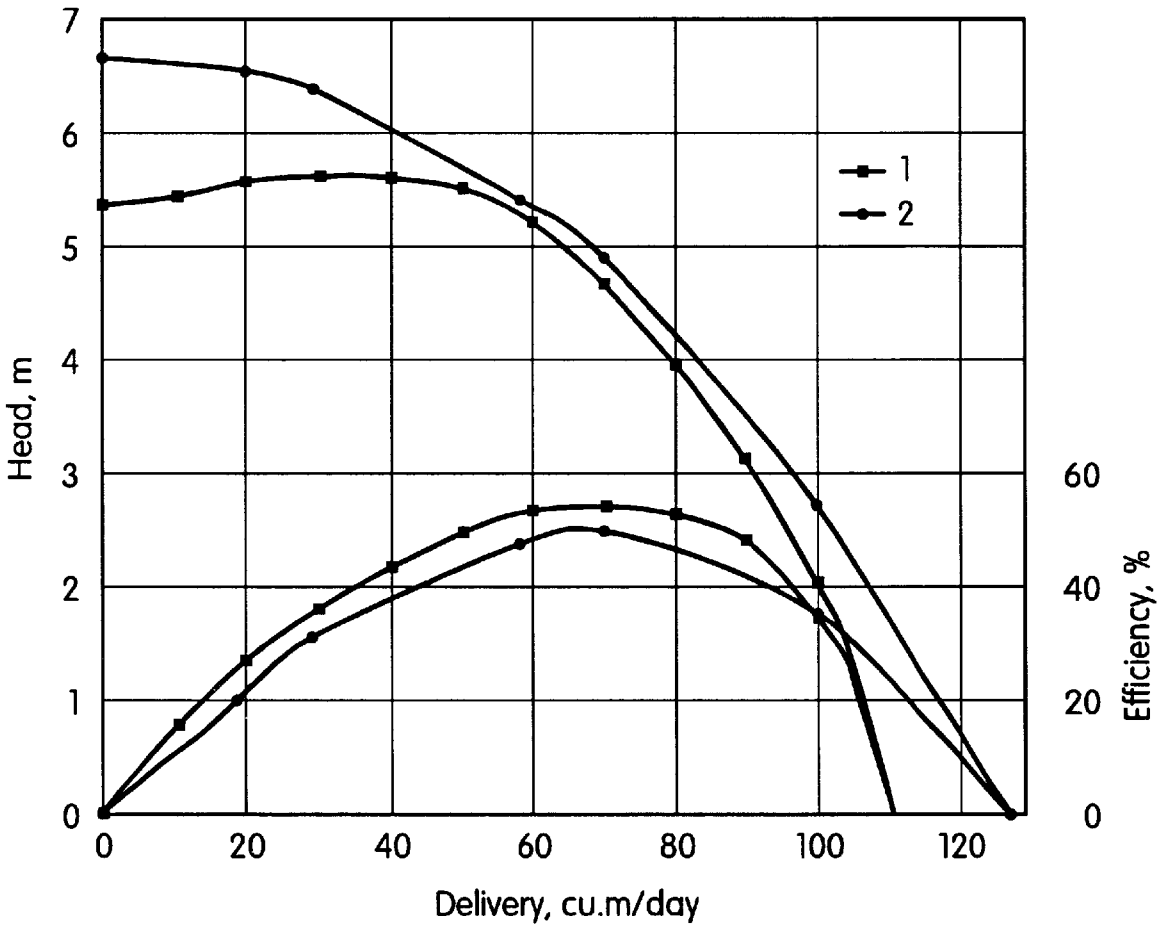
FIG. 2 is an illustration of the head vs. delivery for stages 1 and 2.

FIG. 2 illustrates graphic representation of the head (H, m) and efficiency (%) vs delivery (Q, cu.m/day) for the centrifugal stage 1 and the centrifugal-peripheral stage 2. It is evident that with the delivery rates below 50 cu.m/day the pressure head developed by the centrifugal-peripheral stage is much higher than the corresponding parameter of the centrifugal stage. As a result, the pressure continuously drops, which adds to operating stability and reliability of pumps equipped with such working members.

What is claimed is:

1. A stage of a multistage submersible pump having an impeller which comprises a driving disk and a driven disk with shaped vanes interposed therebetween, and a guide vane assembly having shaped vanes whose leading edges extend beyond an outside diameter of the external lid of the guide vane assembly, wherein triangular cells are provided at the periphery of the impeller driving disk on the lateral surface thereof, said cells being open both radially and axially, and an annular channel is provided on the surface of the external lid of the guide vane assembly, said surface facing the triangular cells.

2. A stage of claim 1, wherein the surface of the lateral annular channel is spaced apart from the upper edge of the impeller cells at least 0.3 times the depth of the latter.

3. A stage of claim 1, wherein the length of the cells is not in excess of 0.3 times the driving disk radius.

* * * * *